US006068958A

United States Patent [19]

Yang et al.

[11] Patent Number: 6,068,958

[45] Date of Patent: May 30, 2000

[54] INFRARED SENSITIVE ELECTROPHTOGRAPHIC PHOTORECEPTORS AND METHOD FOR TUNING PHOTOSENSITIVIEY THEREOF

[75] Inventors: Chen-Jen Yang; Kuo-Chu Yeh; Tsong-Shin Jean; Kai-Der Ker, all of Hsinchu, Taiwan

[73] Assignee: Sinonar Corporation, Hsinchu, Taiwan

[21] Appl. No.: 09/137,876

[22] Filed: Aug. 20, 1998

[51] Int. Cl.[7] ..... G03G 5/06

[52] U.S. Cl. ..... 430/78; 540/141; 430/135

[58] Field of Search ..... 430/78, 58.8, 135; 540/141

[56] References Cited

U.S. PATENT DOCUMENTS

| | | | |
|---|---|---|---|
| 5,194,354 | 3/1993 | Takai et al. | 430/78 |
| 5,378,569 | 1/1995 | Nukada et al. | 430/58.8 |
| 5,420,268 | 5/1995 | Desilets et al. | 540/141 |

*Primary Examiner*—John Goodrow
*Attorney, Agent, or Firm*—W. Wayne Liauh

[57] ABSTRACT

A family of photoreceptors for use in electrophotography are disclosed which contain a binary charge generation composition of oxytitanium phthalocyanine and copper phthalocyanine. The charge generation composition exhibits adjustable photosensitivity by adjusting a ratio between said oxytitanium phthalocyanine and said copper phthalocyanine. To optimize its performance, the charge generation composition is subject to an ammonia-modified complexation-mediated crystal transformation, and the resultant composition is characterized by Bragg diffraction angles (2θ±2°) of 7.7, 9.4, 10.7, 13.3, 15.2, 15.7, 26.3, 27.4, and 28.4 degrees with respect to the CuKα characteristic X-ray wavelength at 1.54 Å and absorption maxima centered around 615, 690, and 770 nm in the optical absorption spectrum. The photosensitivity of the charge generation composition can be modulated according to the formula of $$\frac{V_{ddp}}{2E_{1/2}} = \sum_i \frac{X_i V_{ddp,i}}{2E_{1/2,i}}$$

where i denotes each component in the charge generation mixture, X is the molar fraction $V_{ddp}$ is the dark development potential and $E_{1/2}$ is the half decay energy.

13 Claims, 6 Drawing Sheets

INFRARED SENSITIVE ELECTROPHTOGRAPHIC PHOTORECEPTORS AND METHOD FOR TUNING PHOTOSENSITIVIEY THEREOF

FIELD OF THE INVENTION

The present invention relates to a family of improved organic photoconductors. More specifically, the present invention relates to a novel charge generation component of an organic photoconductor for use in electrophotography such as copiers and laser printers. One of the main advantages of the photoconductor of the present invention is that its photosensitivity can be specifically adjusted so as to provide optimal performance under a variety of electrophotographic applications. The photoconductor disclosed in the present invention also exhibit the advantages of ease of manufacturing, low cost, non-toxicity, and excellent long-term stability including dispersional stability.

BACKGROUND OF THE INVENTION

Organic photoconductors have been widely used in electrophotography such as laser printers and copiers to serve the function as an image transfer medium for image formation. There are several distinctly attractive features of using organic photoconductors compared to inorganic photoconductors; these include ease of manufacturing, low cost, non-toxicity, and flexibility of tailoring structures and properties. Infrared sensitive organic photoconductors have been found and used in printers that incorporate diode lasers as the light source. Function-separated photoconductors have been constructed to achieve optimal photoelectric response and provide acceptable wear resistance in repeated use. In dual-layer photoreceptors, charge generation and charge transporting layers are constructed to perform their respective functions. A subbing layer may be deposited between the conducting substrate and the charge generation layer to provide good adhesion in the junction and to block charge carriers which may be otherwise injected from the conducting substrate. In some instances, conductive particles at sub-micron size are embedded in the subbing layer to prevent reflection of light beams from the conducting substrate. To reinforce wear resistance, a thermosetting polymer film of high mechanical strength may be coated on the charge transporting layer to form a protective layer for the photoreceptors.

As a result of increasing demand on high-quality printing, versatile laser printers affording high-speed printing and good resolution are being constantly developed and commercialized. To fit the printing quality of various types of printers, it is important to choose suitable organic photoconductors exhibiting an optimal photosensitivity in association with toners to produce high-quality printing. In addition to providing the desirable photosensitivity, photoreceptors are also required to sustain high charge voltage in the dark. The ability to experience only a minimal dark decay of charging potential is an important prerequisite for photoreceptors to exhibit acceptable photoelectric response. Undesirable printed image patterns such as background in white and ghosting will be produced as a result of insufficient charging voltage.

There are several organic materials that are highly photosensitive to light in the wavelength range of 750 nm to 850 nm, corresponding to the emission of diode lasers. Among them, phthalocyanine, squaraines and perylenes are especially of interest because of their expedient photoresponse. Recently, much attention has been directed to the research and development of oxytitanium phthalocyanine for use as a charge generation component of organic photoconductors. It was shown that charge generation efficiency and related photoelectric properties of oxytitanium phthalocyanine depend closely on the crystal forms of the material. Charge generation efficiency close to unity has been reported for a certain crystal form known as Y-TiOPc.

It was disclosed in the teaching of U.S. Pat. No. 4,898,799 that Y-TiOPc can be obtained by the treatment of chlorine-containing solvents such as dichloroethane and dichlorobenzene following re-precipitation of the sulfuric acid solution of the material. U.S. Pat. Nos. 5,132,197 and 5,432,278 taught a highly photosensitive oxytitanium phthalocyanine (I-TiOPc) obtained by treating the material with n-butyl ether following re-precipitation of the sulfuric acid solution. The teachings of U.S. Pat. Nos. 5,298,617 and 5,440,029 disclosed hydrated oxytitanium phthalocyanine of which crystal structure could also be classified as the Y form. In a related U.S. Pat. No. 5, 567,559, the content of which is incorporated herein by reference, it was disclosed that a unique form of highly sensitive and ultra-pure oxytitanium phthalocyanine can be obtained by complexation-mediated crystal transformation incorporating ammonia gas and organic solvents as the transformation medium. The ammonia-modified oxytitanium phthalocyanine was characterized by a unique set of spectroscopic data, such as x-ray diffraction and optical absorption, spectrum, relative to Y-TiOPc or I-TiOPc. In line with the exploitation of oxytitanium phthalocyanine as a xerographic material, major efforts have been directed to the modification of crystal structure to achieve efficient charge generation and resulting high photosensitivity of oxytitanium phthalocyanine.

It is equally important to find methods for the effective dispersion of oxytitanium phthalocyanine in a polymer matrix so to form a high-quality charge generation layer. Homogeneous dispersion and environmental stability of the charge generation layer are key factors related to the so-called "cycle down" of dark development potential in xerographic processes. In the teaching of U.S. Pat. No. 5,384,222, it was disclosed that the dark decay for a charge generation layer containing Type IV (Y form) oxytitanium phthalocyanium could become a serious problem after repeated uses, and that judicious choices of polymer binders such as polystyrene-4-vinyl pyridine may provide a way to alleviate the problem of cycling down Good dispersion and the resulting appreciable photosensitivity have been shown in U.S. Pat. No. 5,112,711 for a charge generation layer comprising a combination of oxytitanium phthalocyanine and, to a lesser extent, fluorine-substituted oxytitanium phthalocyanine. In U.S. Pat. No. 5,283,146, an amount of less than 10 parts by weight of nitro- or halogen-substituted oxytitanium phthalocyanine was added to 100 parts by weight of oxytitanium phthalocyanine to form the charge generation component exhibiting good dispersion and desirable photoelectric properties.

U.S. Pat. No. 5,153,313 taught a process involving the precipitation of photosensitive mixtures from organic acid solutions for the preparation of well-mixed composites consisted of a metal-free phthalocyanine, a metal phthalocyanine, and a metalloxy phthalocyanine. In U.S. Pat. No. 4,981,767, evaporated mixed crystals of phthalocyanine compounds, whose compositions included H2-phthalocyanine, Cu-phthalocyanine, TiO-phthalocyanine and VO-phthalocyanine etc., were disclosed to achieve the functions of increased heat and light stability and sufficient photosensitivity.

The aforementioned prior art teachings provided certain improvements in the photosensitivy of photoconductors;

however, none of them discussed the issue relating to the variations in the photosensitivity as the composition of the photosensitive material changes. The disclosed art also never taught or suggested any method which can be utilized to tailor the photosensitivity in various photoreceptor applications. It is highly desirable to develop photoreceptors which can provide variable photosensitivity so as to be able to provide a wide range of compatibility with the various toners to achieve preferred printing quality. Furthermore, in the prior art teachings, the amount of nitro- or halogen-substituted derivative added to unsubstituted oxytitanium phthalocyanine was reported to be limited within 10 wt %.

In an article entitled "Cocrystalline Mixtures of Titanyl fluorophthalocyanine and Unsubstituted Titanyl Phthalocyanine," by M. F. Molaire, J. T. Henry, T. Zubil, and J. E. Kaeding, IS&Ts NIP13, International Conference on Digital Printing Technologies, it was reported that the crystalline mixtures of titanyl fluorophthalocyanine and unsubstituted titanyl phthalocyanine exhibit electrophotographic sensitivities that are at least 50% faster than the individual phthalocyanines treated in the same manner. This article examplifies that commonly observed synergism in a mixture of photosensitive compounds especially charge generation materials. While the synergism may be desired in that it can improve the electrophotographic sensitivities of individual photosensitive compounds, but too high a photosensitivity may not be desired in certain applications. In fact, different applications may require different levels of photosensitivity. In order to design a simple photosensitive system that can be advantageously and conveniently utilized in a wide range of different working conditions, it is highly desirable to explore such a photosensitive system which would exhibit tunable photosensitivity.

SUMMARY OF THE INVENTION

The primary object of the present invention is to develop a family of photoreceptors which can exhibit "tunable" photosensitivity. More specifically, the primary object of the present invention is to develop a family of photoreceptors whose photosensitivity can be readily adjusted to fit the demand of preferred image patterns, such as specified stroke widths, enhanced resolution, etc.

After years of dedicated research work, the co-inventors have found a novel composition which can satisfy this need. The co-inventors have found that a novel composition, which consists of oxytitanium phthalocyanine and copper phthalocyanine, exhibits extensive miscibility both in the coating dispersion and in the resulting thin film for photogeneration. Unexpected results were observed in that when oxytitanium phthalocyanine and copper phthalocyanine are mixed to form a binary charge generation component of a photoreceptor, the photosensitivity of the photoreceptor can be tuned readily by varying the composition of oxytitanium phthalocyanine and copper phthalocyanine. The structures of oxytitanium phthalocyanine and copper phthalocyanine are shown in FIG. 1.

The observed tunable photosensitivity arises from the fact that the charge generation efficiency, being the ratio of the number of charge carriers generated to the number of incident photons, differentiates each other for oxytitanium phthalocyanine and copper phthalocyanine. The as-prepared charge generation layer in conjunction with a suitable subbing layer and a charge transporting layer constitute the photoreceptors with tunable photosensitivity.

As a result of a series of extensive studies of photoresponse for the mixture of oxytitanium and copper phthalocyanine, a correlation was found to describe the combinational photosensitivity. For photoreceptors with expedient photoresponse, the photosensitivity can be approximated by the ratio of the amount of diminished electrical potential to the half-decay energy, $V_{ddp}/2E_{1/2}$, in which $V_{ddp}$ is the dark development potential and $E_{1/2}$ is the half decay energy. For the particular combination of oxytitanium phthalocyanine and copper phthalocyanine as disclosed in the present invention, the photosensitivities of the two charge generation components are found to be additive with respect to the final photosensitivity. This correlation can be expressed as $$\frac{V_{ddp}}{2E_{1/2}} = \sum_i \frac{X_i V_{ddp,i}}{2E_{1/2,i}}$$

where Xi is mole fraction, and i=1,2 representing the charge-generating component of oxytitanium phthalocyanine and copper phthalocyanine, respectively. With the composition disclosed in the present invention, this correlation can be used to predict the photosensitivity of the photoreceptors consisted of oxytitanium phthalocyanine and copper phthalocyanine. Therefore, the invention provides an effective method to prepare photoreceptors with desirable photosensitivity for the usage in high-resolution printing technology.

The oxytitanium phthalocyanine/copper phthalocyanine composition of the present invention also exhibits excellent dispersion when used in preparing the charge generation layer of the photoreceptors. This is achieved by applying a specific mixing method incorporating a complexation-mediated crystal transformation process on the binary mixture of oxytitanium phthalocyanine and copper phthalocyanine. As a result of a balanced intermolecular interaction between oxytitanium phthalocyanine, copper phthalocyanine and the polymer binder, the mixture has been found to exhibit excellent dispersion in the solid state. The binary charge generation mixture is also found be completely miscible and therefore the composition of each component could be adjusted at any value between 0% and 100%. According to the methods disclosed in this invention, the as-prepared charge generation coating solution has been demonstrated to maintain excellent homogeneity for a time span of more than six months. Consequently, homogeneous thin films of charge generation layers devoid of observable aggregation of particles can be obtained from the coating solution.

The photoreceptors incorporating the charge generation mixture disclosed in the invention also exhibit an optimal photoresponse. Using the aforementioned binary charge generation mixture as the charge generation layer, the photoreceptors so prepared are found to exhibit excellent optical quality without showing observable scattering of the light beam. Significantly, the photoreceptors comprising the binary charge generation component of the present invention exhibit minimal extent of dark decay and the problem of cycling down is alleviated.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

Figure 1A:
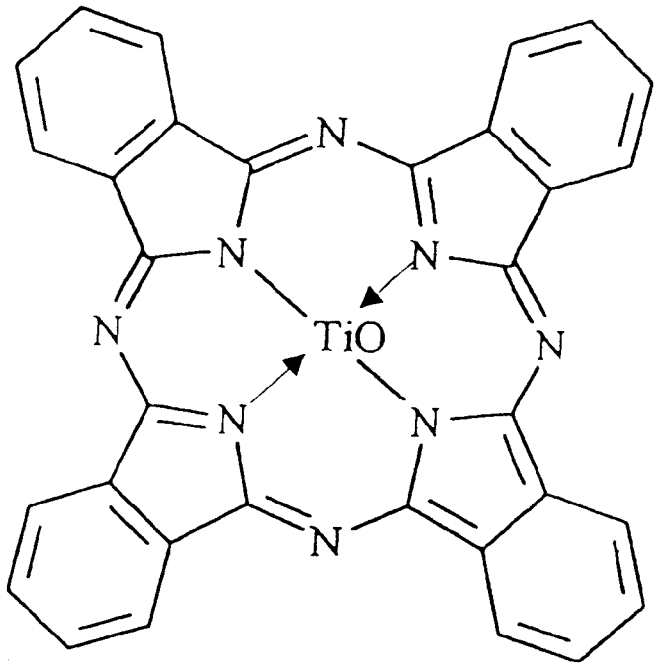
FIGS. 1A and 1B show the structures of oxytitanium phthalocyanine (TiOPc) and copper phthalocyanine (CuPc), respectively.
Figure 1B:
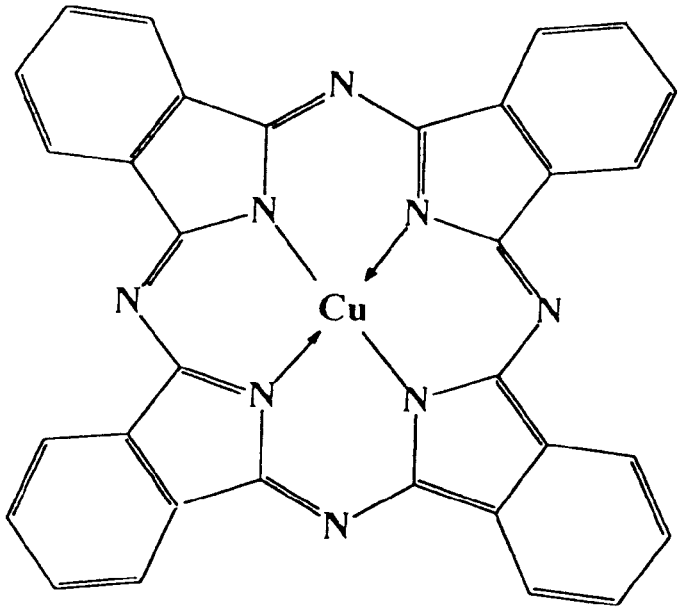

The present invention discloses a novel photosensitive system which consists of oxytitanium phthalocyanine and copper phthalocyanine in variable proportions. According to a preferred embodiment of the process disclosed in the present invention for preparing the novel photosensitive system, oxytitanium phthalocyanine and copper phthalocyanine at a pre-selected composition are initially mixed in a ball mill device. The ball-milled mixture is subsequently subject to the complexation-mediated crystal transformation process, in which organic solvents such as ammonia and chlorobenzene are used as the transformation media, for the fine tuning of the photosensitivity. This complexation-mediated crystal transformation resulted in conformity of mixing, thus achieving excellent homogeneity of the mixture of oxytitanium phthalocyanine and copper phthalocyanine, in addition to the benefit of imparting a refinement of their photoelectric properties.

In one preferred embodiment, 80 parts by weight of oxytitanium phthalocyanine was mixed with 20 parts by weight of copper phthalocyanine in a ball mill device, and the milling was continued for 3 days. The phthalocyanine mixture was then placed in a paint shaker containing aqueous ammonia solution (~30 wt % ammonia) and chlorobenzene to facilitate further mixing and crystal transformation. The weight ratio of phthalocyanine mixture to aqueous ammonia solution was kept in a range of from 1:5 to 5:1, preferably from 1:2 to 2:1. For the transformation media, the ratio of aqueous ammonia solution to chlorobenzene was kept in a range of from 1:2 to 1:20, preferably from 1:5 to 1:10. After 8 hrs of processing in the paint shaker, the phthalocyanine mixture was filtered and washed with methyl ethyl ketone, and subsequently dried to afford a powder of the charge generation material of this invention.

Other embodiments employed mixtures of oxytitanium phthalocyanine and copper phthalocyanine in which the compositions of the binary mixture were varied between 0 and 100 mol %. Homogeneous mixtures were also obtained from the same ball milling and crystal transformation process that not only enabled extensive mixing of two components but also resulted in a specific crystal structure. X-ray diffraction analyses indicate that the crystal structure of the binary photosensitive mixture is characterized by a set of 2θ angles of7.8, 9.4, 10.6, 13.2, 16.1, 23.9, 26.3, and 27.3 degrees. This particular crystal structure is due to the ammonia complexation on the binary phthalocyanine mixture and is believed to lead to the preferred photoelectric properties. During the crystal transformation process, ammonia gas can be used in place of aqueous ammonia solution. On the other hand, other organic solvents, such as dichloroethane, dichlorobenzene and n-butyl ether, can be used in place of chlorobenzene to achieve the same function. The replacement of solvent media does not change the aforementioned ratio of amount of materials used in the process.

For the preparation of photoreceptors, a layered configuration comprising a blocking layer (BL), a charge generation layer (CGL) and a charge transporting layer (CTL) was constructed. Each layer has its respective functionality to contribute to properties and performance of the photoreceptors. Suitable materials for use in the blocking layer are those with hole blocking and electron transporting capabilities. Also, blocking-layer materials must be able to exhibit good adhesion with respect to both the metal surface (i.e., the conducting substrate) and the overlaying organic film (i.e., the charge generation layer). Commonly used blocking-layer materials include polyamides, polyesters, poly(methyl methacrylate), poly(vinyl chloride), poly(vinyl alcohol), poly(vinyl acetate), poly (acrylic acid), phenolic resins. These polymer resins were first dissolved in suitable organic solvents to form coating solutions for the coating of blocking layers with a thickness in a range of from 0.1 to 10 μm, preferably from 0.5 to 2 μm.

Charge generation layers were formed using the same dip coating technique for forming blocking layers. The aforementioned charge generation phthalocyanine compounds were dispersed in suitable organic solvents such as cyclohexanone and methyl ethyl ketone (MEK), and, subsequently, polymer binder resins were introduced to the dispersed mixture to form coating solutions for the coating of charge generation layers. Known materials may be used for constituting the polymer binder in the charge generation layer. Examples of suitable materials include polystyrene, poly(vinyl acetate), poly(vinyl butyral), poly(vinyl chloride), poly(methyl methacrylate), polyester, polycarbonate (bisphenol A type or Z type), phenol-formaldehyde resins, and silicone resins.

The ratio of charge generation components to polymer binder is usually set in the range from 1:10 to 10:1, preferably from 1:2 to 2:1. It was found that increased amounts of charge generation components would lead to better photosensitivity, whereas increased amounts of polymer binder would lead to better dispersion. Thickness of the charge generation layers can be varied in the range from 0.01 to 5 μm, preferably from 0.05 to 2 μm.

Charge transporting layers are usually made of a polymer binder and an electroactive component, or a so-called charge transporting material. The polymer binder is the material responsible for providing wear resistance of the photoreceptors. Compatibility between the polymer binder and the charge transporting material is important with regard to the thermodynamic phase stability of the solid mixture. In addition, it has been reported that high polarity is required in order for the polymer binder to be a satisfactory matrix in which charge transporting material can transport charge efficiently. Commonly used polymer binder materials for use in the charge transporting layers include polycarbonates such as bisphenol A type or Z type resins, polystyrene, polysulfone, acrylic resins, and acrylonitrile-styrene copolymers. Known charge transporting materials usually exhibit charge carrier mobility in a range of from $10^{-6}$ to $10^{-4}$ $cm^2/V$ sec. Examples of such materials are aromatic tertiary amino compounds, hydrazone derivatives, oxadiazole derivatives, quinazoline derivatives, and fluorenone compounds etc.

In the present invention, a hydrazone compound as shown in the following structural representation was used as the charge transporting material.

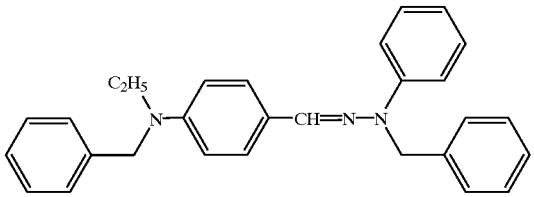

This hydrazone compound was molecularly distributed in a polymer matrix (polycarbonate Z type, PCZ) to constitute the charge transporting layer of the photoreceptors. In preparing the coating solutions, hydrazone and PCZ were codissolved in toluene. Weight ratio of hydrazone to PCZ was kept in a range of from 3:5 to 1:1 in which a higher hydrazone content was found to result in more efficient charge transport, but at the expense of thermodynamic phase stability of the solid mixture. Solid content including both hydrazone and polycarbonate was maintained between 15 and 25% by weight with respect to the total weight of the solution. The obtained thickness was in a range of from 15 to 40 $\mu$m, preferably 20 to 30 $\mu$m.

The key photosensitive material in this invention, oxytitanium phthalocyanine, was synthesized according to known literature methods. The synthesis procedures are described briefly as follows:

To a 300 milliliter three-necked flask filter with condenser, thermometer, and mechanical stirrer was added phthalonitrile (38.6 g, 302 mmol) and 134 milliliter 1-chloronaphthalene. The mixture was heated to 60° C. under nitrogen atmosphere and then titanium tetrachloride (12.9 g, 68 mmol) was added. Therefore, the reaction mixture was heated slowly to 200–220° C. and maintained at this temperature range for 3 hr to complete the reaction. The mixture was left to cool to room temperature and then 80 ml methanol was added to precipitate was collected by filtration, followed by successive washing of warm methanol (4×150 ml), warm deionized water (4×150 ml), and methanol (3×100 ml). The product was dried at 50° C. under vacuum overnight to afford dark-blue powder of oxytitanium phthalocyanine (27.2 g, 47 mmol). Elemental analysis was performed to determine purity of the as-synthesized oxytitanium phthalocyanine, indicating close agreement between the found and the expected compositions of oxytitanium phthalocyanine. The following is the tabulated data of the elemental analysis

| | C (mol %) | H (mol %) | N (mol %) |
|---|---|---|---|
| Found: | 66.68 | 2.80 | 19.44 |
| Expected: | 65.83 | 2.94 | 19.04 |

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed. It should be noted that all the parts and percentages in the following examples are by weight unless otherwise indicated.

EXAMPLE 1

80:20 TiOPc/CuPc was mixed and processed to prepare a binary charge generation mixture. 8 g of the above-mentioned as-synthesized oxytitanium phthalocyanine and 2 g of copper phthalocyanine was added to a cylindrical container containing ~1 cm glass beads and subsequently the mixture was subject to mechanical grinding for 3 days. Subsequent to this mill treatment, the material was washed and filtered and dried in an air-blowing environment at room temperature. The material was then added, along with 10 g aqueous ammonia solution and 100 g chlorobenzene, to a paint shaker container containing 1 mm glass beads. This mechanical grinding was continued for 10 hr to complete crystal transformation to the desired crystal form. The as-treated material was collected by filtration and subsequently washed with methyl ethyl ketone (3×200 ml).

Figure 2:
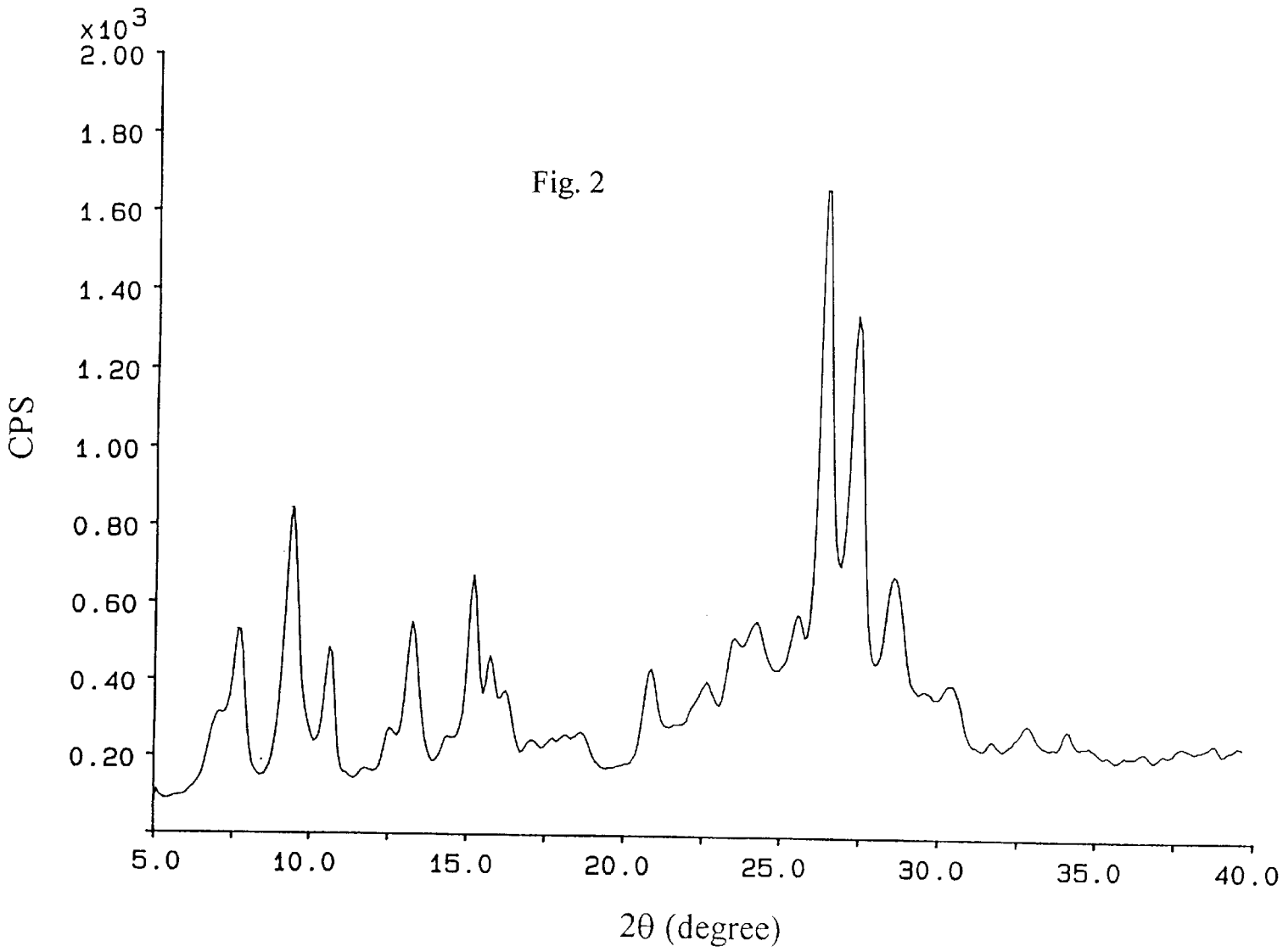
FIG. 2 is an X-ray powder diffraction pattern obtained from the refined 80:20 TiOPc/CuPc.

X-ray powder diffractometry (XRPD) was performed to provide characteristics of the crystal form of the above treated oxytitanium phthalocyanine (TiOPc) and copper phthalocyanine (CuPc) mixture. The XRPD spectrum was obtained with X-ray of CuK$\alpha$ at a wavelength of 1.541 Å. FIG. 2 is the XRPD pattern for this 80:20 TiOPc/CuPc mixture, indicating Bragg diffraction angles (2$\theta$) of 7.7, 9.4, 10.7, 13.3, 15.2, 15.7, 26.3, 27.4 and 28.4 degrees.

Figure 3:
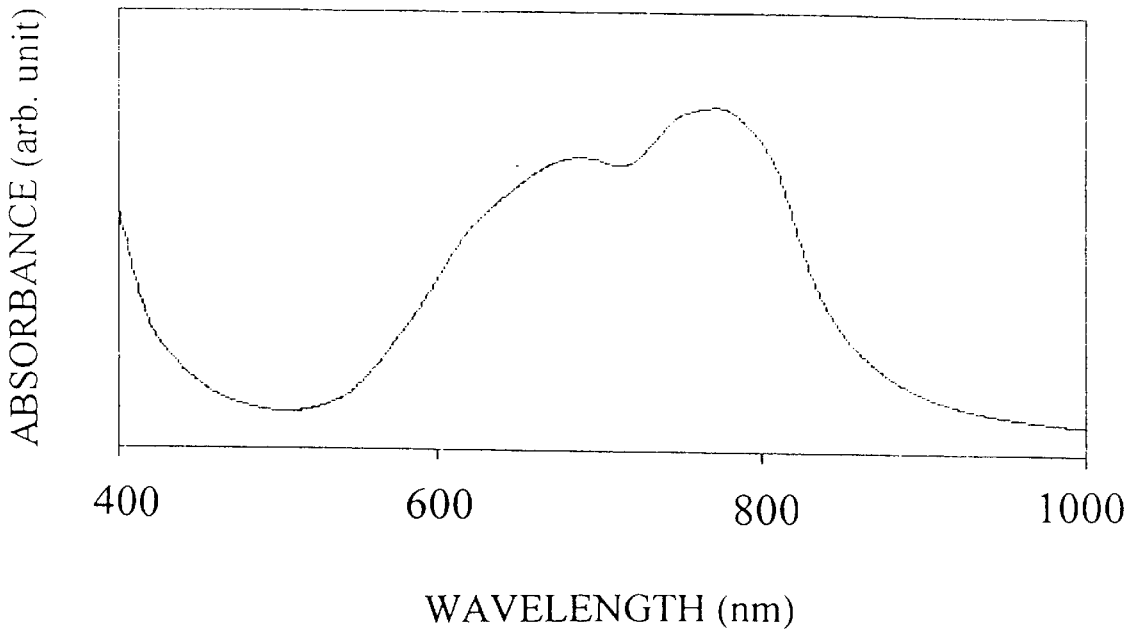
FIG. 3 is an optical absorption spectrum of the refined 80:20 TiOPc/CuPc.

10 g of the above-mentioned 80:20 TiOPc/CuPc mixture was sand milled with 57.2 g cyclohexanone solution of poly(vinyl butyral) (10 wt %) and 100 g cyclohexanone for 3 days to obtain a fine dispersion of TiOPc/CuPc of which the particle size was not larger than 0.3 mm. The dispersion was further diluted with 120 g cyclohexanone and 285.8 g methyl ethyl ketone to complete preparation of charge generation layer coating solution. Thin films for optical absorption spectroscopic measurements were prepared by spreading the charge generation solution on plain glass substrates, followed by slow drying in a vacuum oven. FIG. 3 shows the optical absorption spectrum for 80:20 TiOPc/CuPc mixture dispersed in poly(vinyl butyral). This 80:20 TiOPc/CuPc mixture exhibits a clear absorption peak at around 770 nm, and a second absorption peak at around 690 nm.

To determine photoelectric properties of the above 80:20 TiOPc/CuPc charge generation mixture, a layered photoreceptor incorporating a blocking layer, a charge generation layer and a charge transporting layer was constructed. On top of an cylindrical aluminum substrate, consecutive dip coatings were performed to form a 1.0-$\mu$m layer of hole-blocking copolyamide, a 0.2-$\mu$m generation layer of 80:20 TiOPc/CuPc dispersed in poly(vinyl butyral), and a 20-$\mu$m transporting layer of Z-type polycarbonate (PCZ) containing electroactive hydrazone molecules. This photoreceptor was mounted on a photoinduced discharge device to measure its photoelectric properties. The photoelectric measurement is described as follows. First, the photoreceptor was electrostatically charged with a corona discharge with an applied voltage of 4.3 kV which led to an initial surface potential, $V_0$, of around −690 volts. After resting for 2 seconds in the dark, the charged member reached a surface potential, $V_{ddp}$, which is called the dark development potential. The photoreceptor was subsequently exposed to filtered light (780 nm) from a halogen lamp. The exposure of light was continued for 2 seconds and then a surface potential defined as the residual potential, $V_r$, was recorded. Dark decay in volts per second was calculated as $-(V_0-V_{ddp})/2$. Half exposure energy, $E_{1/2}$($\mu$J/cm$^2$), was determined by finding amount of energy needed to reduce surface potential to half of its initial value ($V_{ddp}/2$). Half exposure energy is a value indicating the photosensitivity. A lower $E_{1/2}$ value indicates a higher photosensitivity. Similarly, $E_{1/6}$ defined as the energy needed to reduce surface potential to one sixth of its initial value was also determined.

Photoelectric data obtained from the above-mentioned measurement are collected in Table 1. For the photoreceptor containing the refined 80:20 TiOPc/CuPc as charge generation component, the photoelectric properties are characterized as a dark decay value of 5 volts/sec, a residual potential $V_r$ of −11 volts, an $E_{1/2}$ value of 0.24 $\mu J/cm^2$, and an $E_{1/6}$ value of 0.64 $\mu J/cm^2$. According to a conventional definition of photosensitivity of photoreceptors, the initial slope of the observed photoinduced discharge curve (PIDC) was determined to give an indication of the readiness of surface potential drop under light exposure. This photosensitivity value is calculated to be 1420 volt·$cm^2$/mJ and is nearly identical to the value calculated by $V_{ddP}/2E_{1/2}$.

EXAMPLE 2

60:40 TiOPc/CuPc was mixed and processed to prepare a binary charge generation mixture. 6 g of oxytitanium phthalocyanine and 4 g of copper phthalocyanine were subject to vigorous grinding in a cylindrical container ~1 cm glass beads for a time period of 3 days. After washing and drying, the mixture was added to a paint shaker along with 10 g aqueous ammonia solution and 100 g chlorobenzene for vigorous grinding to facilitate further mixing and refinement of crystal structure. The refined mixture was then recovered by filtration and washed with methyl ethyl ketone.

TABLE 1

Photoelectric Properties: dark decay ($-(V_0 - V_{ddp})/2$), dark development potential ($V_{ddp}$), half-exposure energy ($E_{1/2}$), and one-sixth exposure energy ($E_{1/6}$).

| | $-(V_0 - V_{ddp})/2$ volts/sec | $V_{ddp}$ volts | $V_r$ volts | $E_{1/2}$ $\mu J/cm^2$ | $E_{1/6}$ $\mu J/cm^2$ |
|---|---|---|---|---|---|
| Example 1 | 5 | −680 | −11 | 0.24 | 0.64 |
| Example 2 | 8 | −666 | −15 | 0.32 | 0.86 |
| Example 3 | 7 | −676 | −19 | 0.35 | 0.94 |
| Example 4 | 4 | −688 | −40 | 0.54 | 1.68 |
| Example 5 | 5 | −670 | −67 | 1.05 | 2.86 |
| Comp. Example 1 | 3 | −671 | −25 | 0.18 | 0.66 |
| Comp. Example 2 | 5 | −680 | −465 | N/A* | N/A* |

*The photoreceptor containing 100 mol % CuPc as charge generation material in comparative example 2 did not show noticeable photosensitivity under exposure of 780 nm light beam.

Figure 4:
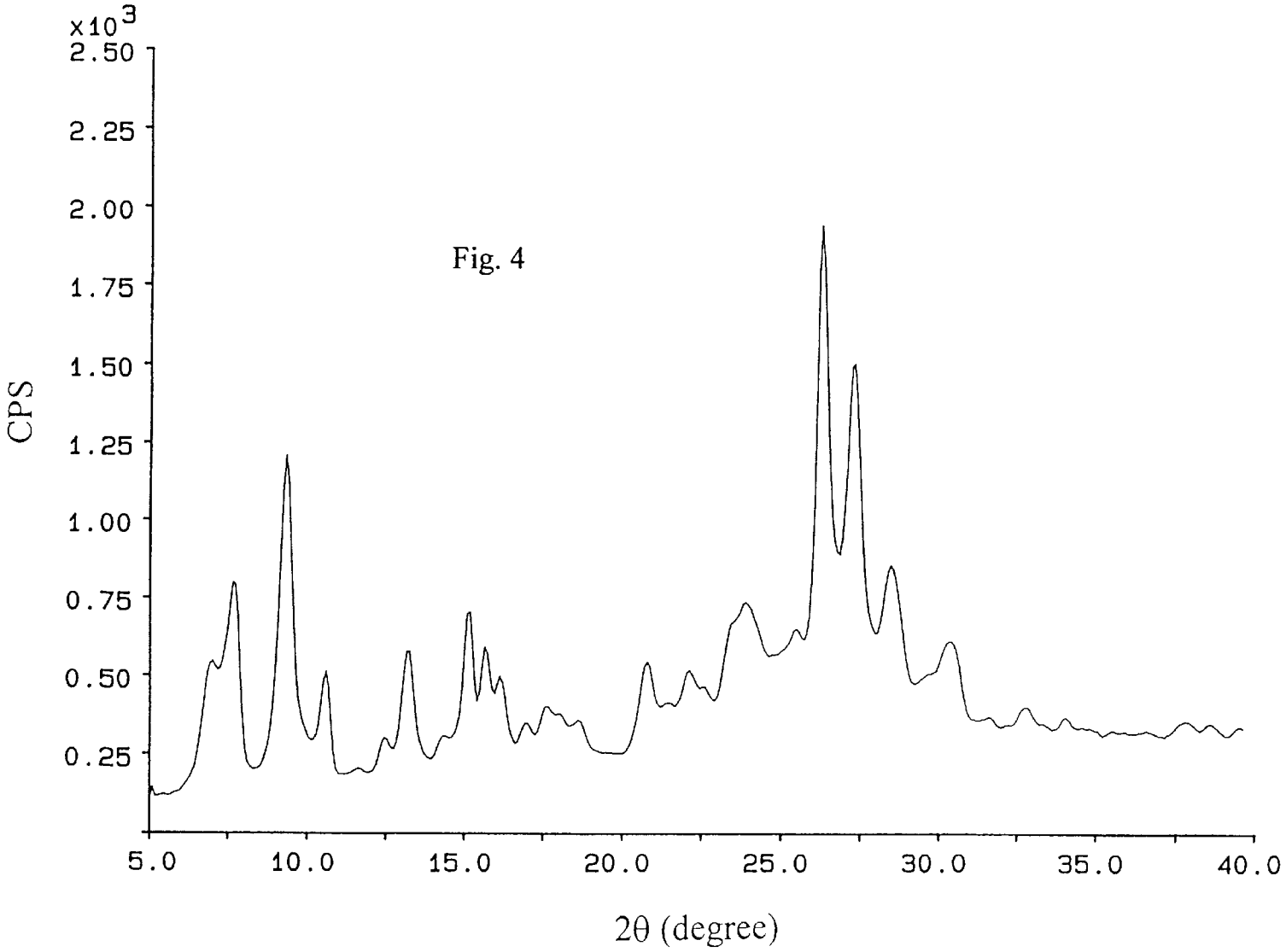
FIG. 4 is an X-ray powder diffraction pattern obtained from the refined 60:40 TiOPc/CuPc.

FIG. 4 shows the XRPD pattern for this refined 60:40 TiOPc/CuPc that indicates Bragg diffraction angles (2θ) of 7.8, 9.4, 10.6, 13.2, 15.2, 15.7, 26.3, 27.3, and 28.4 degrees.

Figure 5:
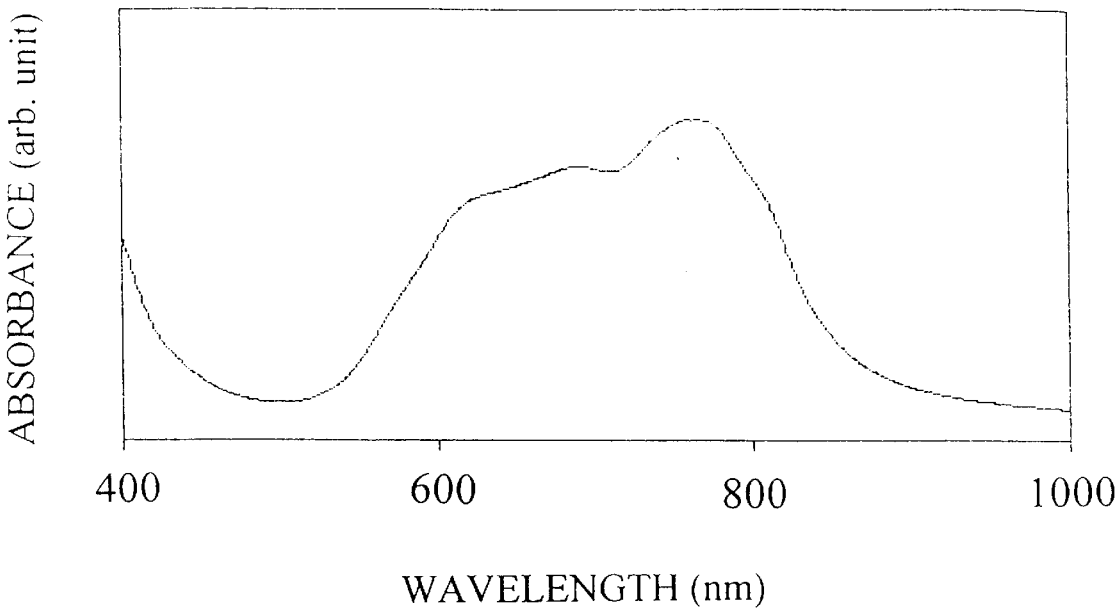
FIG. 5 is an optical absorption spectrum of the refined 60:40 TiOPc/CuPc.

For preparation of the coating solution of the charge generation layer, the 60:40 TiOPc/CuPc mixture was added to a paint shaker along with poly(vinyl butyral) and cyclohexanone for vigorous grinding. The concentrated solution was then diluted with cyclohexanone and methyl ethyl ketone to form the solution for dip coating. This coating solution was spread on a plain glass substrate and was dried to form a thin film for optical absorption spectroscopic measurement. FIG. 5 shows the optical absorption spectrum of the 60:40 TiOPc/CuPc dispersed in poly(vinyl butyral), indicating a strong absorption peak at 770 nm and an absorption shoulder at 690 nm and another absorption shoulder at 615 nm.

The photoreceptor containing the 60:40 TiOPc/CuPc mixture as a charge generation component was prepared by the same procedure described in example 1. The other factors such as thickness and composition of blocking layer and charge transporting layer were kept the same such that the photoinduced discharge measurement would reveal the effect of composition variation in charge generation layer on the photoelectric properties. Shown in Table 1, the photoelectric data indicate readily tunable photosensitivity of the TiOPc/CuPc charge generation component. For this 60:40 TiOPc/CuPc mixture, $E_{1/2}$ value was found as 0.32 $\mu J/cm^2$ and ther photoelectric properties such as $V_0$ and $V_r$values were also regulated by variation of composition of TiOPc and CuPc. The photosensitivity, expressed as $V_{ddp}/2E_{1/2}$, is determined to be 1040 volt·$cm^2/\mu J$.

Comparative Example 1

Instead of using binary TiOPc/CuPc mixture as charge generation components, pure TiOPc was prepared to constitute the charge generation layer of the photoreceptor. Similar processes such as ball mill and ammonia modification were performed on the pure TiOPc. Shown in Table 1, the $E_{1/2}$ and $E_{1/6}$ values for the photoreceptor containing TiOPc were determined as 0.18 and 0.66 $\mu J/cm^2$, respectively. The photosensitivity, expressed as $V_{ddp}/2E_{1/2}$, is found to be 1834 volt·$cm^2/\mu J$.

Comparative Example 2

Pure CuPc is used as the charge generation component in this example as indicated in Table 1, the pure CuPc does not show sensible photoresponse in photoinduced discharge measurement and its photosensitivity is approximately approaching zero compared to other charge generating components in this invention.

EXAMPLE 3

40:60 TiOPc/CuPc was mixed and its crystal form was refined for use as a charge generation component. Following the same consecutive processes aimed at mixing and refining TiOPc/CuPc, the mixture was prepared for evaluation of its photosensitivity by photoinduced discharge measurement. For the photoreceptor containing this refined 40:60 TiOPc/CuPc charge generation component, $E_{1/2}$ and $E_{1/6}$ values are 0.54 and 1.68 $\mu J/cm^2$, respectively, as indicated in Table 1. The photosensitivity, expressed as $V_{ddp}/2E_{1/2}$, is determined as 637 volt·$cm^2/\mu J$.

EXAMPLE 4

20:80 TiOPc/CuPc was mixed and its crystal form was refined for use as a charge generation component. After ball mill and ammonia-modified transformation treatments, the refined mixture was collected and then sand milled with cyclohexanone, poly(vinyl butyral) and methyl ethyl ketone to prepare the coating solution for the charge generation layer. The photoreceptor containing this refined 20:80 TiOPc/CuPc charge generation component is characterized with dark decay, residual potential, $E_{1/2}$, and $E_{1/2}$ values of −5 volts, −67 volts, 1.05 $\mu J/cm^2$, and 2.86 $\mu J/cm^2$, respectively. The photosensitivity, expressed as $V_{ddp}/2E_{1/2}$, is determined as 319 volt·$cm^2\mu/J$.

Figure 6:
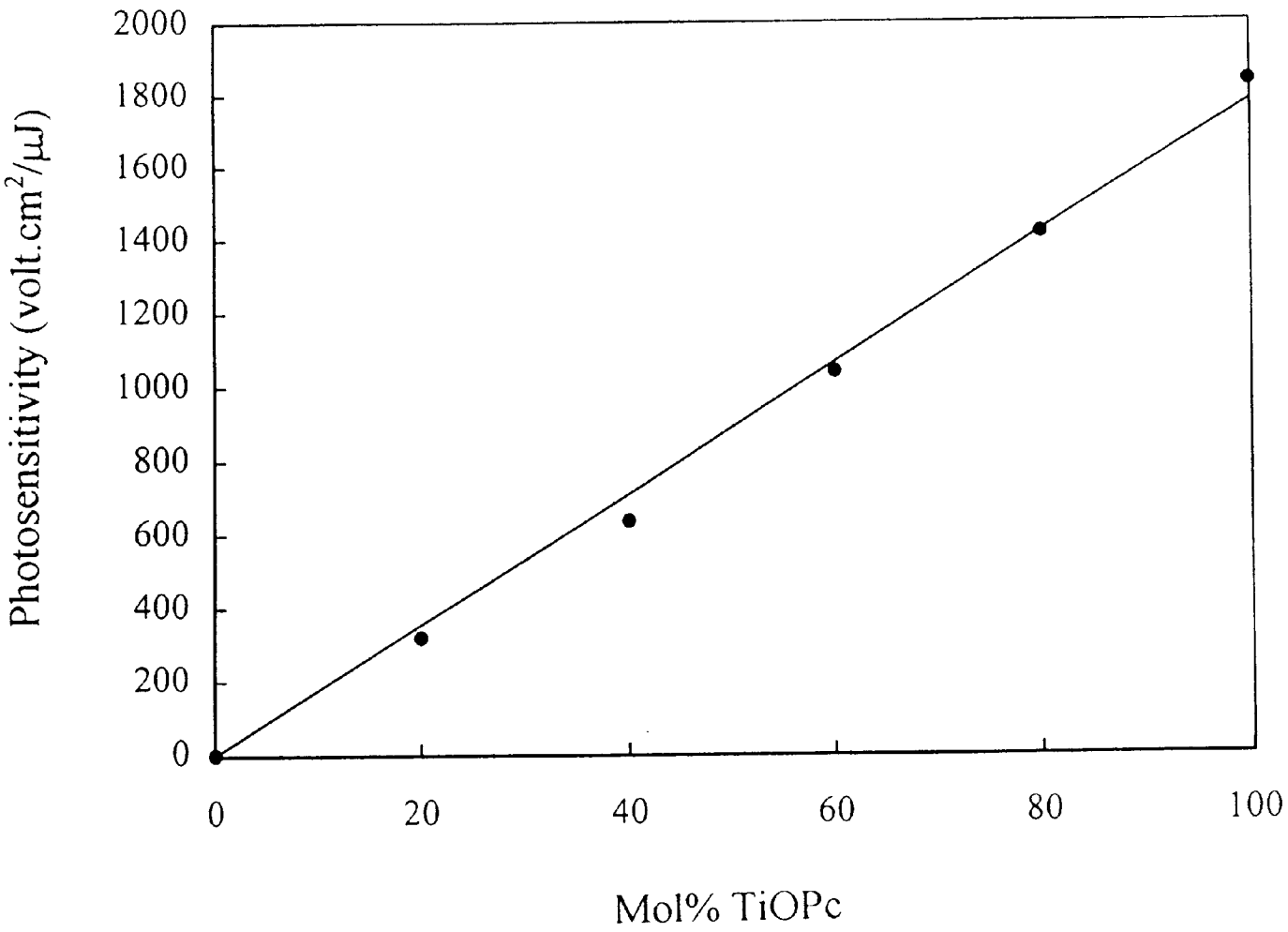
FIG. 6 is the photosensitivity tuned by varying compositions of charge generating TiOPc/CuPc mixture.

Clearly, tunable photosensitivity has been achieved by varying the compositions of binary charge generation components described in the above examples. FIG. 6 shows the plot of photosensitivity adjusted by varying compositions of the TiOPc/CuPc mixture in the photoreceptors. According to the linear relationship obtained for photosensitivity and compositions, a correlation can be established to describe the tunable photosensitivity:

$$\frac{V_{ddp}}{2E_{1/2}} = \sum_i \frac{X_i V_{ddp,i}}{2E_{1/2,i}}$$

in which $X_i$ is the molar fraction for TiOPc or CuPc. Therefore, the photosensitivity can be optimized by selecting the composition of TiOPc and CuPc to perform the preferred printings.

EXAMPLE 5

Four types of oxytitanium phthalocyanines were extracted from the different stages of the processes of ammonia-modified crystal transformation and their individual and additive photosensitivities were measured. These samples were randomly selected during the course of ball milling and ammonia-modified crystal transformation and, therefore, their photosensitivity values were varied. The photosensitivity values are listed as follows:

| Sample | $E_{1/2}$, $\mu J/cm^2$ | Amount added in The Mixture |
|---|---|---|
| TiOPc1 | 0.24 | 924 g |
| TiOPc2 | 0.26 | 1940 g |
| TiOPc3 | 0.54 | 1785 g |
| TiOPc4 | 0.51 | 1608 g |

Preparations of the electrophotographic photoreceptors were followed by the procedures stated in Example 1. The mixture of charge generation materials was obtained by mixing the cyclohexanone solutions of separate components in a paint shaker device. After sand milled for 3 days, methyl ethyl ketone and cyclohexanone solution of poly(vinyl butyral) were added to complete the preparation of the mixture of charge generation materials. The prepared organic photoconductor containing the above charge generation mixture, was measured to show a half-exposure value of 0.35 $\mu J/cm^2$. The calculation using the photosensitivity equation in this invention shows $E_{1/2}$ of 0.348 $\mu J/cm^2$ which is extremely close to the measured value.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A photoreceptor for use in electrophotography containing a binary charge generation composition of oxytitanium phthalocyanine and copper phthalocyanine which exhibits adjustable photosensitivity by adjusting a ratio between said oxytitanium phthalocyanine and said copper phthalocyanine; wherein said binary charge generation composition of oxytitanium phthalocyanine and copper phthalocyanine has been subject to an ammonia-modified complexation-mediated crystal transformation so as to exhibit a linearly additive photosensitivity as described by the following formula:

$$\frac{V_{ddp}}{2E_{1/2}} = \sum_i \frac{X_i V_{ddp,i}}{2E_{1/2,i}}$$

where i denotes each component in the charge generation composition, X is the molar fraction $V_{ddp}$ is the dark development potential and $E_{1/2}$ is the half decay energy.

2. The photoreceptor according to claim 1 wherein said binary charge generation composition contains about 1 to about 99 mol % of oxytitanium phthalocyanine and about 1 to about 99 mol % of copper phthalocyanine.

3. The photoreceptor according to claim 1 wherein said binary charge generation composition contains about 20 to about 80 mol % of oxytitanium phthalocyanine and about 20 to about 80 mol % of copper phthalocyanine.

4. The photoreceptor according to claim 1 wherein said binary charge generation composition of oxytitanium phthalocyanine and copper phthalocyanine is characterized by Bragg diffraction angles (2θ±2°) of 7.7, 9.4, 10.7, 13.3, 15.2, 15.7, 26.3, 27.4, and 28.4 degrees with respect to the CuKα characteristic X-ray wavelength at 1.54 Å.

5. The photoreceptor according to claim 1 wherein said binary charge generation composition of oxytitanium phthalocyanine and copper phthalocyanine is characterized by having absorption maxima centered around 615, 690, and 770 nm in the optical absorption spectrum.

6. The photoreceptor for electrophotography according to claim 1 wherein said the binary charge generation composition of oxytitanium phthalocyanine and copper phthalocyanine compound is dispersed in poly(vinyl butyral) to form a charge generation layer.

7. A process for preparing a charge generation mixture comprising the following steps:

(a) mixing solid powders of oxytitanium phthalocyanine and copper phthalocyanine in a mixing device to form an amorphous mixture; and (b) dispersing and mixing said amorphous mixture in a mixture of an organic solvent and an aqueous ammonia solution to effectuate an ammonia-modified complexation-mediated crystal transformation so as to obtain a homogeneous and highly photosensible mixture for charge generation which exhibits a linearly additive photosensitivity.

8. The process for preparing a charge generation mixture according to claim 7 wherein said charge generation mixture contains about 1 to about 99 mol % of oxytitanium phthalocyanine and about 1 to about 99 mol % of copper phthalocyanine.

9. The process for preparing a charge generation mixture according to claim 7 wherein said charge generation mixture contains about 20 to about 80 mol % of oxytitanium phthalocyanine and about 20 to about 80 mol % of copper phthalocyanine.

10. The process for preparing charge generation mixture according to claim 7 wherein said organic solvent is chlorobenzene.

11. The process for preparing charge generation mixture according to claim 7 wherein said aqueous ammonia solution is a saturated aqueous ammonia solution.

12. The process for preparing charge generation mixture according to claim 7 wherein said charge generation mixture and said the organic solvent are provided in a weight ratio form about 1:2 to about 1:20.

13. The process for preparing charge generation mixture according to claim 7 wherein said charge generation mixture and said the aqueous ammonia solution are provided in weight ratio from about 1:5 to about 5:1.

* * * * *